US008714699B2

(12) United States Patent
Suzuki

(10) Patent No.: US 8,714,699 B2
(45) Date of Patent: May 6, 2014

(54) IMAGE FORMING APPARATUS HAVING CARRIAGE MOUNTING RECORDING HEAD FOR EJECTING LIQUID DROPLETS

(71) Applicant: Kazuki Suzuki, Kanagawa (JP)

(72) Inventor: Kazuki Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/766,979

(22) Filed: Feb. 14, 2013

(65) Prior Publication Data

US 2013/0222471 A1 Aug. 29, 2013

(30) Foreign Application Priority Data

Feb. 29, 2012 (JP) ..... 2012-044506

(51) Int. Cl.
*B41J 2/165* (2006.01)

(52) U.S. Cl.
USPC ..... 347/30; 347/32; 347/108

(58) Field of Classification Search
USPC ..... 347/22, 29–33, 44, 47, 65, 67, 71, 85, 347/86, 108
See application file for complete search history.

(56) References Cited

U.S. PATENT DOCUMENTS

| | | | | |
|---|---|---|---|---|
| 7,530,664 | B2 * | 5/2009 | Shimazaki et al. | 347/32 |
| 8,556,378 | B2 * | 10/2013 | Hutchison | 347/33 |
| 2009/0015632 | A1 | 1/2009 | Suzuki et al. | |
| 2009/0122122 | A1 | 5/2009 | Kubo et al. | |
| 2010/0321426 | A1 | 12/2010 | Suzuki et al. | |
| 2012/0056932 | A1 | 3/2012 | Matsubara et al. | |

FOREIGN PATENT DOCUMENTS

| | | |
|---|---|---|
| JP | 9-300644 | 11/1997 |

OTHER PUBLICATIONS

U.S. Appl. No. 13/558,817, filed Jul. 26, 2012, Kazuki Suzuki.

* cited by examiner

*Primary Examiner* — Thinh Nguyen
(74) *Attorney, Agent, or Firm* — Cooper & Dunham LLP

(57) ABSTRACT

An image apparatus includes a carriage, a first recording head, a second recording head, and a maintenance assembly. The carriage is movable in a main scanning direction. The second recording head is displaced from the first recording head on the carriage in a sub scanning direction perpendicular to the main scanning direction. The maintenance assembly includes a frame member, a first maintenance device, and a second maintenance device. The frame member has a guide portion, a first contact portion, and a second contact portion. The second maintenance device is reciprocally movable along the guide portion in the sub scanning direction between a first position to oppose the first recording head and a second position to oppose the second recording head. The second maintenance device stops at the first position in contact with the first contact portion and at the second position in contact with the second contact portion.

5 Claims, 9 Drawing Sheets

37

IMAGE FORMING APPARATUS HAVING CARRIAGE MOUNTING RECORDING HEAD FOR EJECTING LIQUID DROPLETS

CROSS-REFERENCE TO RELATED APPLICATIONS

This patent application is based on and claims priority pursuant to 35 U.S.C. §119 to Japanese Patent Application No. 2012-044506, filed on Feb. 29, 2012, in the Japan Patent Office, the entire disclosure of which is hereby incorporated by reference herein.

BACKGROUND

1. Technical Field

This disclosure relates to an image forming apparatus, and more specifically to an image forming apparatus having a carriage mounting a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatuses employing a liquid-ejection recording method, for example, inkjet recording apparatuses are known that use a recording head (liquid ejection head or liquid-droplet ejection head) for ejecting droplets of ink.

Such a liquid-ejection-type image forming apparatus may have a maintenance assembly (maintenance-and-recovery assembly) to maintain and recover the ejection stability of nozzles of the recording head. The maintenance assembly includes, for example, a suction cap to cap a nozzle face of the recording head for sucking and discharging liquid from the nozzles, a moisture retention cap to prevent drying of ink in the nozzles and intrusion of dust into the nozzles, and a wiper member (also referred to as wiper blade, wiping blade, or blade) to wipe and clean the nozzle face of the recording head. The maintenance assembly performs, for example, recovery operation to form nozzle menisci by wiping the nozzle face with the wiping member after viscosity-increased ink is discharged from the nozzles to the suction cap.

As a conventional type of maintenance assembly, for example, JP-3930587-B1 (JP-09-300644-A) proposes a maintenance assembly movable in a sub-scanning direction perpendicular to a main scanning direction between a maintenance position at which the maintenance assembly opposes recording heads mounted on the carriage to perform maintenance and recovery operation and a retracted position at which the maintenance assembly does not oppose the recording heads.

To enhance the productivity of, e.g., an image forming apparatus, a plurality of recording heads for ejecting the same color of liquid droplets may be displaced in a staggered manner in the sub-scanning direction to increase a print width printable in the sub-scanning direction by a single main scanning. As a maintenance assembly of the image forming apparatus, multiple maintenance units are arranged at such positions that the respective recording heads displaced in the sub-scanning direction can oppose the corresponding maintenance units.

Such a configuration increases the number of components and space in the main scanning direction of the maintenance assembly, thus increasing the width (apparatus size in the main scanning direction) of the image forming apparatus.

BRIEF SUMMARY

In an aspect of this disclosure, there is provided an image forming apparatus including a carriage, a first recording head, a second recording head, and a maintenance assembly. The carriage is movable in a main scanning direction. The first recording head is mounted on the carriage. The first recording head has nozzles in a nozzle face thereof to eject liquid droplets. The second recording head is mounted on the carriage. The second recording head has nozzles in a nozzle face thereof to eject liquid droplets. The second recording head is displaced from the first recording head on the carriage in a sub scanning direction perpendicular to the main scanning direction. The maintenance assembly maintains and recovers the first recording head and the second recording head. The maintenance assembly includes a frame member, a first maintenance device, and a second maintenance device. The frame member has a guide portion, a first contact portion, and a second contact portion. The first maintenance device is held by the frame member. The second maintenance device is reciprocally movable along the guide portion of the frame member in the sub scanning direction between a first position to oppose the first recording head and a second position to oppose the second recording head. The second maintenance device stops at the first position in contact with the first contact portion and at the second position in contact with the second contact portion.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
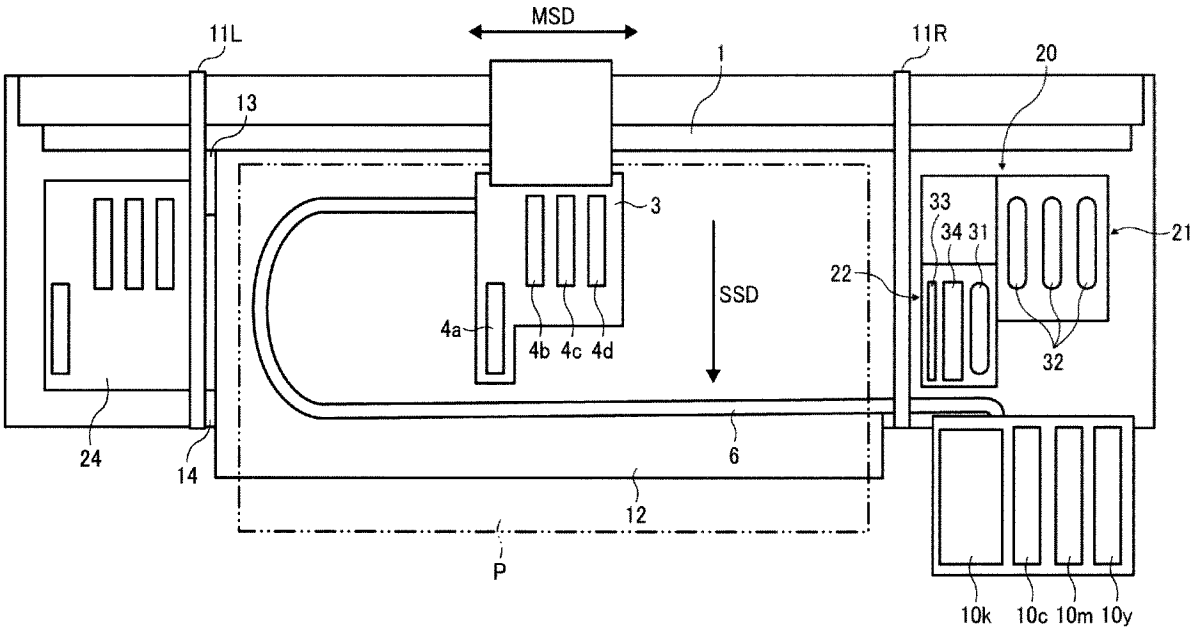
FIG. 1 is a partial plan view of a mechanical section of an image forming apparatus according to an exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

For example, in this disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation", "recording", "printing", "image recording" and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

The image forming apparatus is not limited to a vertical ejection type of image forming apparatus having a recording head to eject liquid droplets downward in the vertical direction, but may be, for example, a horizontal ejection type of image forming apparatus having a recording head to eject liquid droplets in a direction perpendicular to the vertical direction.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment is described below with reference to FIGS. 1 and 2.

Figure 2:
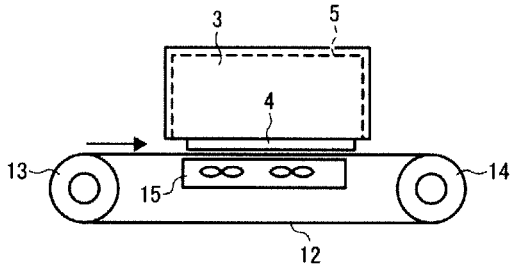
FIG. 2 is a partial front view of the mechanical section illustrated in FIG. 1.

FIG. 1 is a partial plan view of a mechanical section of the image forming apparatus. FIG. 2 is a partial side view of the mechanical section of FIG. 1.

In this exemplary embodiment, the image forming apparatus is described as a serial-type inkjet recording apparatus. In the image forming apparatus, a carriage 3 is supported by a main guide rod 1 and a sub guide rod so as to be movable in a main scanning direction indicated by an arrow MSD in FIG. 1. The main guide rod 1 and the sub guide rod extend between a left side plate 11L and a right side plate 11R. The carriage 3 is reciprocally moved for scanning in the main scanning direction MSD by a main scanning motor via a timing belt looped between a driving pulley and a driven pulley.

The carriage 3 mounts recording heads 4*a*, 4*b*, 4*c*, and 4*d* (collectively referred to as "recording heads 4" unless distinguished) serving as four liquid ejection heads for ejecting liquid droplets. The carriage 3 mounts the recording heads 4 so that multiple nozzle rows, each of which includes multiple nozzles, are arranged parallel to a sub-scanning direction SSD perpendicular to the main scanning direction MSD and liquid droplets are ejected downward from the nozzles.

The recording head 4*a* is displaced from the recording heads 4*b* to 4*d* by one head (one nozzle row) in the sub-scanning direction SSD perpendicular to the main scanning direction MSD. Each of the recording heads 4*a* to 4*d* has two nozzle rows. For example, the recording heads 4*a* and 4*b* eject liquid droplets of the same black color, and the recording heads 4*c* and 4*d* eject liquid droplets of magenta (M), cyan (C), and yellow (Y) from nozzle rows.

For monochrome images, the image forming apparatus uses the recording heads 4*a* and 4*b* to form an image having a width corresponding to two heads by a single scanning (main scanning). For color images, the image forming apparatus uses, for example, the recording heads 4*b* to 4*d* to form a color image.

Each of the recording heads 4*a* to 4*d* has a head tank 5 to supply liquid to each recording head 4. Respective color inks are supplied from the ink cartridges 10*k*, 10*c*, 10*m*, and 10*y* serving as main tanks replaceably mountable to an apparatus body, to the head tanks 5 via supply tubes 6.

The image forming apparatus has a conveyance belt 12 serving as a conveyance device to convey a sheet while adhering the sheet thereon by static electricity. The conveyance belt 12 is an endless belt that is looped between a conveyance roller 13 and a tension roller 14 so as to circulate in a belt conveyance direction (sub-scanning direction SSD). The image forming apparatus also has a suction fan 15 serving as a sucking device to suck a sheet from suction holes of the conveyance belt 12.

The conveyance roller 13 is rotated by a sub-scanning motor via a timing belt and a timing pulley, so that the conveyance belt 12 circulates in the sub-scanning direction SSD illustrated in FIG. 1.

At one end in the main scanning direction MSD of the carriage 3, a maintenance assembly (maintenance-and-recovery assembly) 20 is disposed near a lateral side of the conveyance belt 12 to perform maintenance and recovery on the recording heads 4. At the opposite end in the main scanning direction, a first dummy ejection receptacle 24 is disposed near the opposite lateral side of the conveyance belt 12 to receive liquid droplets ejected from the recording heads 4 by dummy ejection in which liquid droplets not contributing to image formation are ejected for maintenance, e.g., removal of viscosity-increased liquid or bubbles.

As described below, the maintenance assembly 20 has a first maintenance device (first maintenance and recovery device) 21 held by the apparatus body and a second maintenance device (second maintenance and recovery device) 22 supported by the apparatus body so as to be reciprocally movable in the sub-scanning direction SSD. The maintenance assembly 20 includes, for example, a suction cap 31 and moisture-retention caps 32. The suction cap 31 caps a nozzle face (nozzle formed face) of any one of the recording heads 4 to suck liquid from the nozzle face. The suction cap 31 also serves as a moisture-retention cap to cap the nozzle face of the recording head 4*a* for moisture retention. The moisture-retention caps 32 cap nozzle faces of the recording heads 4*b*, 4*c*, and 4*d* for moisture retention. The maintenance assembly 20 also includes a wiping member 33 to wipe the nozzle faces of the recording heads 4 and a second dummy ejection receptacle 34 to receive liquid droplets not contributing to image formation and ejected from the recording heads 4 during dummy ejection.

In the image forming apparatus having the above-described configuration, a sheet P is fed from a sheet feed tray, sucked to adhere on the conveyance belt 12, and conveyed in the sub-scanning direction SSD with the circulation of the conveyance belt 12. By driving the recording heads 4 in response to image signals while moving the carriage 3 in the main scanning direction MSD, liquid droplets are ejected onto the sheet P, which is stopped below the recording heads 4, to record one line of a desired image. After the sheet P is fed by a certain distance, liquid droplets are ejected onto the sheet P to record another line of the image, Receiving a signal indicating that the image recording has been completed or a rear end of the sheet P has arrived at the recording area, the image forming apparatus finishes the recording operation and the sheet P is output to a sheet output tray.

Next, the maintenance assembly 20 according to this exemplary embodiment of this disclosure is further described with reference to FIGS. 3 and 4.

Figure 3:
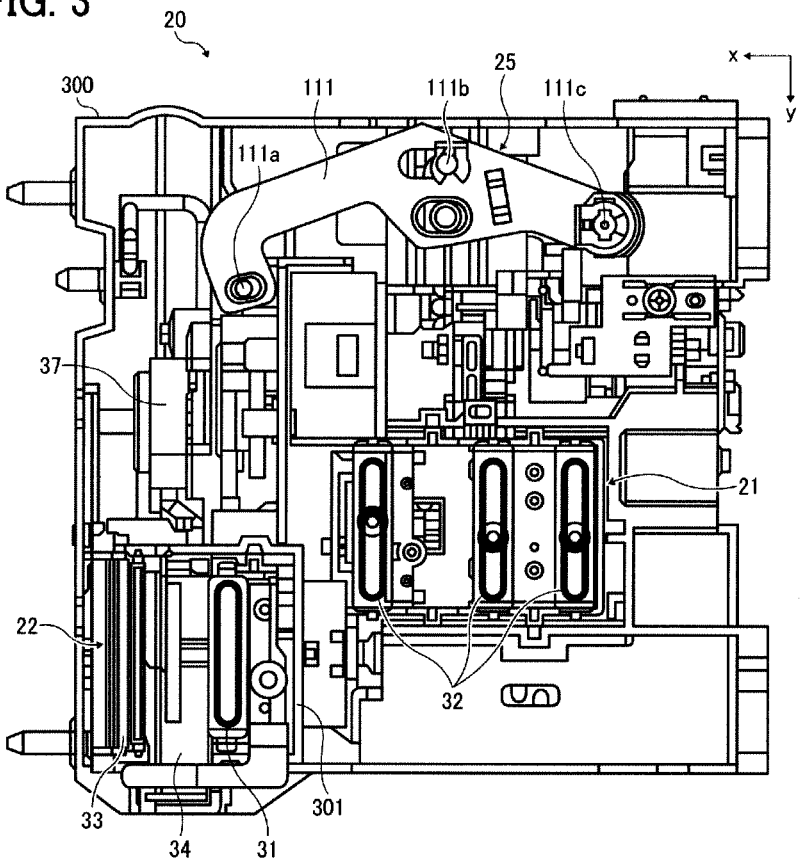
FIG. 3 is a plan view of a maintenance assembly of the image forming apparatus in a state in which a second maintenance device (suction cap) is placed at a first position.

FIG. 3 is a plan view of the maintenance assembly 20 in a state in which the second maintenance device (suction cap) 22 is placed at a first position. FIG. 4 is a plan view of the maintenance assembly 20 in a state in which the second maintenance device 22 is placed at a second position.

In this exemplary embodiment, as described above, one of the recording heads 4*a* to 4*d* is displaced from the others of the recording heads 4*a* to 4*d* in the sub-scanning direction SSD by a length of one nozzle row on the carriage 3 (hereinafter, also referred to as "offset arrangement").

Here, the recording head 4*a* disposed at a downstream side in the sub-scanning direction (sheet conveyance direction) is referred to as a first recording head, and the recording heads 4*b* to 4*d* disposed at an upstream side in the sub-scanning direction are referred to as second recording heads.

The maintenance assembly 20 has the first maintenance device 21 held by the apparatus body and the second maintenance device 22 supported by the apparatus body so as to be reciprocally movable in the sub-scanning direction.

The first maintenance device 21 includes the three moisture-retention caps 32 corresponding to the recording heads 4*b* to 4*d* at such positions that the moisture-retention caps 32 can cap the recording heads 4*b* to 4*d* serving as the second recording heads.

The second maintenance device 22 includes the suction cap 31, the wiping member 33, the second dummy ejection receptacle 34, and a suction pump 37, e.g., a tubing pump serving as a suction device connected to the suction cap 31.

Figure 4:
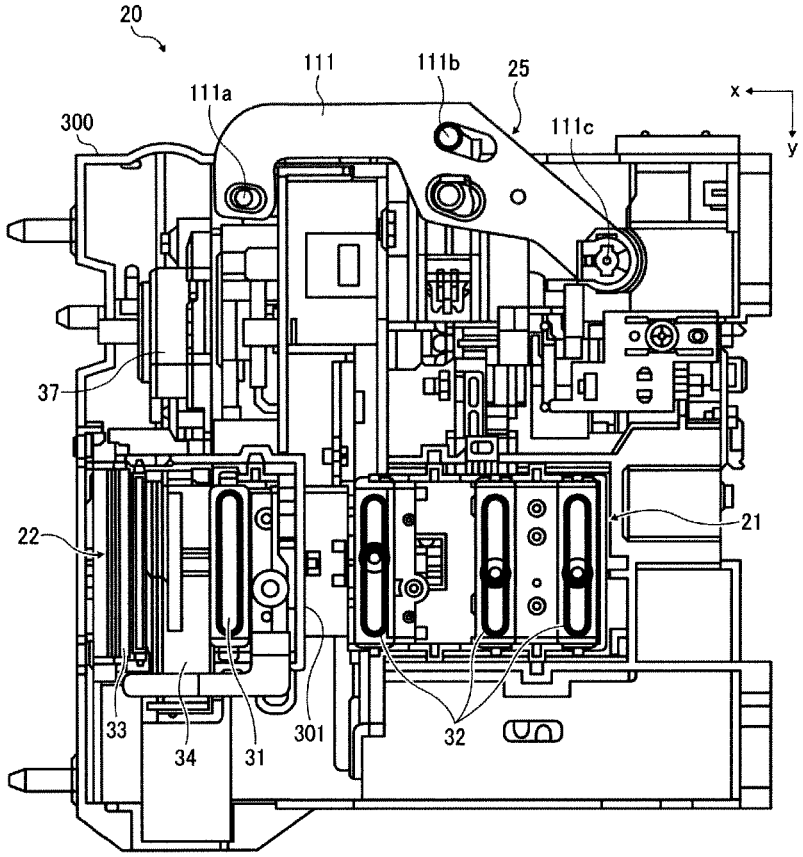
FIG. 4 is a plan view of the maintenance assembly in a state in which the second maintenance device is placed at a second position.

The second maintenance device 22 is disposed on a maintenance frame 300 serving as a frame member of the entire maintenance device 20 so as to be reciprocally movable between the first position illustrated in FIG. 3 and the second position illustrated in FIG. 4. At the first position, as illustrated in FIG. 3, the second maintenance device 22 performs maintenance and recovery operation on the recording head 4*a* serving as the first recording head. At the second position, as illustrated in FIG. 4, the second maintenance device 22 performs maintenance and recovery operation on the recording heads 4*b* to 4*d* serving as the second recording heads.

The first maintenance device 21 is disposed on the maintenance frame 300. In addition, a driving device 25 is disposed on the maintenance frame 300. The driving device 25 includes an advancing and retreating unit to advance and retreat the moisture retention caps 32 of the first maintenance device 21 (in this example, upward and downward in a vertical direction) relative to the recording heads 4*b* to 4*d* and a reciprocal moving unit to reciprocally move the second maintenance device 22 in the sub-scanning direction (in this example, in a horizontal direction).

The second maintenance device 22 is supported on the maintenance frame 300 so as to be movable in the sub-scanning direction.

The driving device 25 moves the second maintenance device 22 in the sub-scanning direction via an arm 111. The arm 111 has a fulcrum 111*b*, a point of effort 111*c* to receive a driving force from a driving source (driving motor), and a point of application 111*a* to transmit the driving force to the second maintenance device 22.

By receiving the driving force from the driving source, the arm 111 rotates, thus allowing the second maintenance device 22 to reciprocally move between the first position at which, e.g., the suction cap 31 can oppose the recording head 4*a* and the second position at which, e.g., the suction cap 31 can oppose the recording heads 4*b* to 4*d*.

The suction cap 31 is held by a cap holder and advanced and retreated (in this example, upward and downward in a vertical direction) relative to the recording heads 4 by the advancing and retreating unit. The wiping member 33 is held by a wiper holder and advanced and retreated (in this example, upward and downward in the vertical direction) relative to the recording heads 4 by the advancing and retreating unit.

The reciprocal movement of the second maintenance device 22 and the advancing and retreating movement (upward and downward movement) of the moisture-retention caps 32 relative to the recording heads 4 via the driving device 25 are performed by forward and reverse rotation of the driving source (driving motor) and drive switching via two one-way clutches.

The advancing and retreating (upward and downward) movement of the suction cap 31 relative to the recording heads 4 and the driving of the suction pump 37 are performed by forward and reverse rotation of a driving source (driving motor) disposed at the second maintenance device 22 and drive switching via a one-way clutch.

Next, determination of a stop position of the second maintenance device 22 is described with reference to FIGS. 5 to 10.

Figure 5:
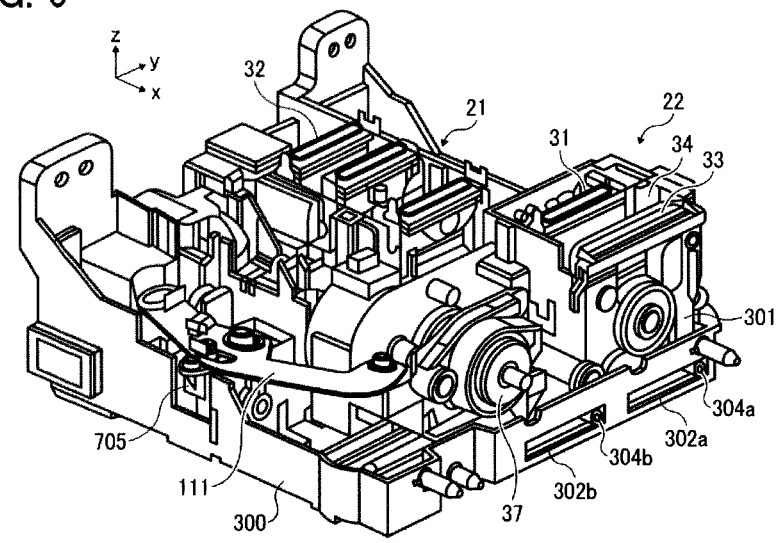
FIG. 5 is a perspective view of the maintenance assembly in the state in which the second maintenance device is placed at the first position.
Figure 6:
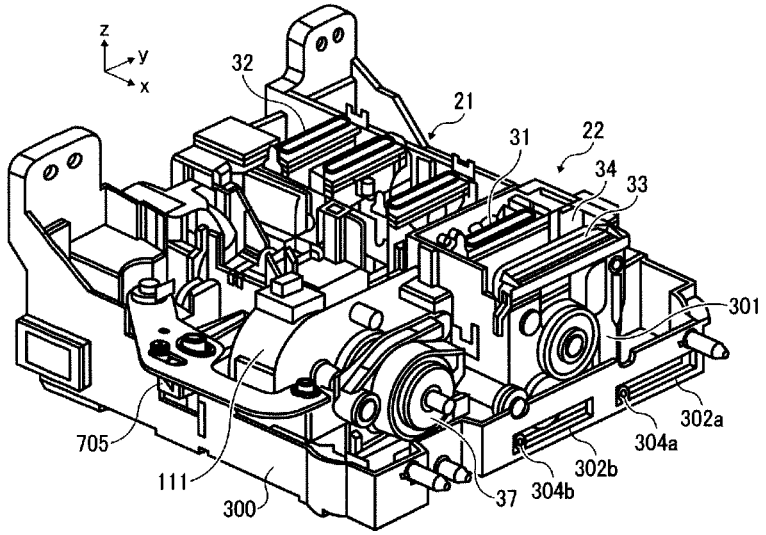
FIG. 6 is a perspective view of the maintenance assembly in the state in which the second maintenance device is placed at the second position.
Figure 7:
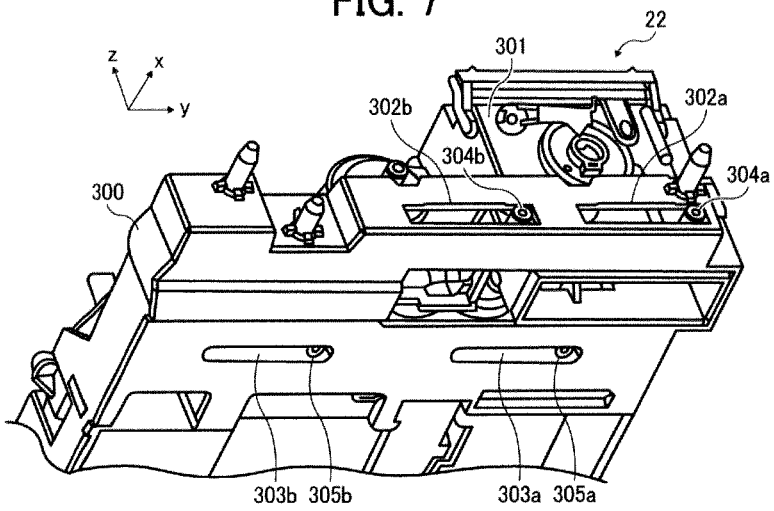
FIG. 7 is a perspective view of the maintenance assembly seen from a bottom side in the state in which the second maintenance device is placed at the first position.
Figure 8:
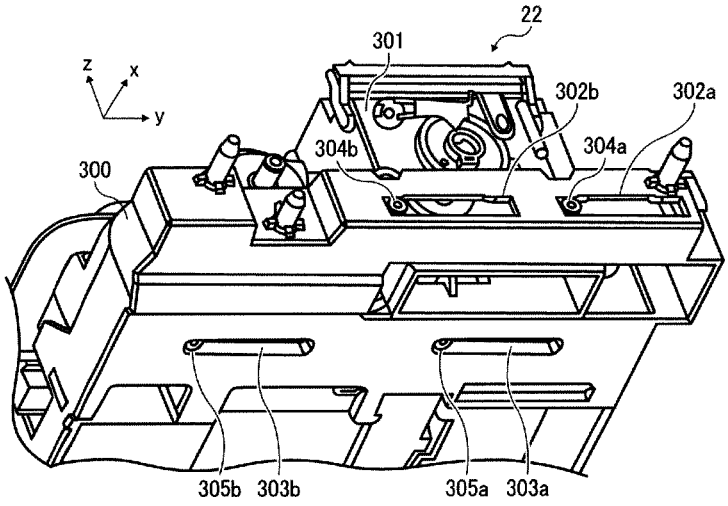
FIG. 8 is a perspective view of the maintenance assembly seen from a bottom side in the state in which the second maintenance device is placed at the second position.
Figure 9:
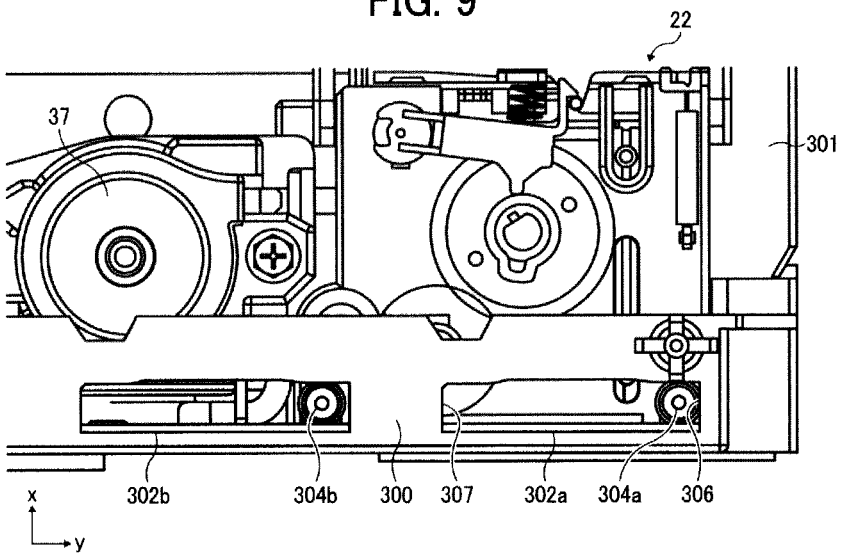
FIG. 9 is a side view of the maintenance assembly in the state in which the second maintenance device is placed at the first position.

FIG. 5 is a perspective view of the maintenance assembly 20 in the state in which the second maintenance device 22 is at the first position. FIG. 6 is a perspective view of the maintenance assembly 20 in the state in which the second maintenance device 22 is at the second position. FIG. 7 is a perspective view of the maintenance assembly 20 seen from a bottom side in the state in which the second maintenance device 22 is at the first position. FIG. 8 is a perspective view of the maintenance assembly 20 seen from the bottom side in the state in which the second maintenance device 22 is at the second position. FIG. 9 is a side view of the maintenance assembly 20 in the state in which the second maintenance device 22 is at the first position. FIG. 8 is a side view of the maintenance assembly 20 in the state in which the second maintenance device 22 is at the second position.

At a lateral side of the second maintenance device 22, the maintenance frame 300 has first guide portions 302*a* and 302*b* that are long holes formed along the sub-scanning direction (an y-axis direction in FIGS. 5 to 10).

A maintenance cleaner frame 301 serving as a frame member of the second maintenance device 22 has first reference shafts 304*a* and 304*b* that protrude outward to movably engage the first guide portions 302*a* and 302*b*, respectively.

Movement of the first reference shafts 304*a* and 304*b* in a z-axis direction (height direction) is restricted by the first guide portions 302*a* and 302*b*, respectively.

As illustrated in FIGS. 7 and 8, the maintenance frame 300 has second guide portions 303*a* and 303*b* at a bottom face side of the second maintenance device 22. The second guide portions 303*a* and 303*b* are long holes formed along the sub-scanning direction (y-axis direction).

The maintenance cleaner frame 301 of the second maintenance device 22 has second reference shafts 305*a* and 305*b* at a bottom face to movably engage the second guide portions 303*a* and 303*b*, respectively.

Movement of the second reference shafts 305*a* and 305*b* in an x-axis direction (main scanning direction) is restricted by the second guide portions 303*a* and 303*b*.

Figure 10:
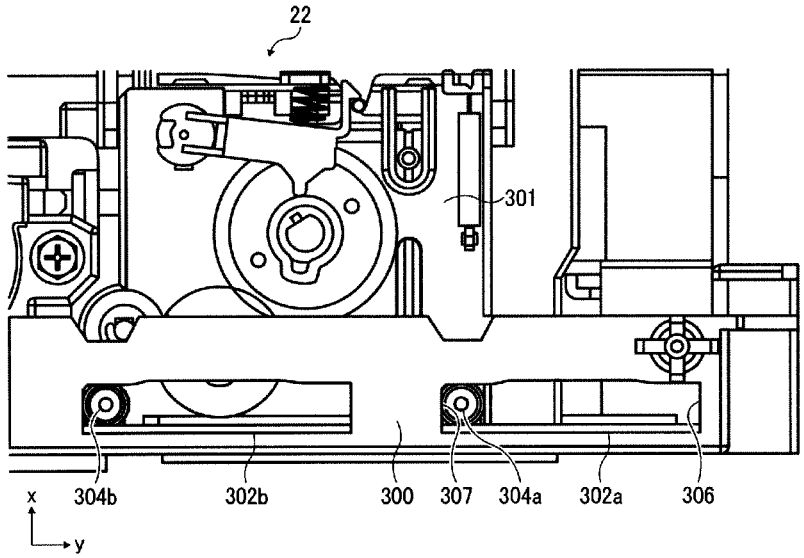
FIG. 10 is a side view of the maintenance assembly in the state in which the second maintenance device is placed at the second position.

As illustrated in FIGS. 9 and 10, the first guide portion 302*a* has a first contact portion 306 at a downstream side end and a second contact portion 307 at an upstream side end in the sub-scanning direction (y-axis direction). The first reference shaft 304*a* contacts the first contact portion 306 and the second contact portion 307.

As a result, when the second maintenance device 22 moves from the second position to the first position, as illustrated in FIG. 9, the first reference shaft 304*a* contacts the first contact portion 306, thus stopping and positioning the second maintenance device 22.

When the second maintenance device 22 moves from the first position to the second position, as illustrated in FIG. 10, the first reference shaft 304*a* contacts the second contact portion 307, thus stopping and positioning the second maintenance device 22.

As described above, according to this exemplary embodiment, the second maintenance device 22 can he positioned with a simple configuration.

It is to be noted that such contact portions to contact the first reference shaft 304*a* are not limited to the first and second contact portions 306 and 307 and may be, for example, end portions of any other guide portion in the sub-scanning direction.

Next, the driving device 25 in this exemplary embodiment is further described with reference to FIGS. 11 to 16.

Figure 11:
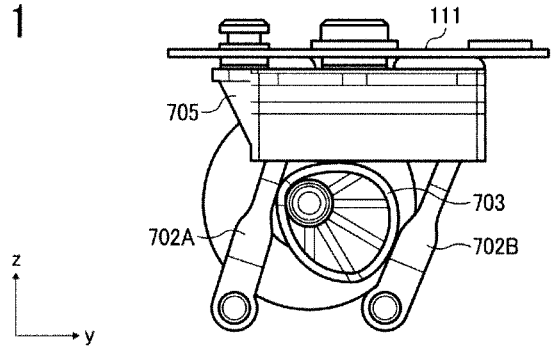
FIG. 11 is a side view of a driving device of the maintenance assembly in the state in which the second maintenance device is placed at the first position.
Figure 12:
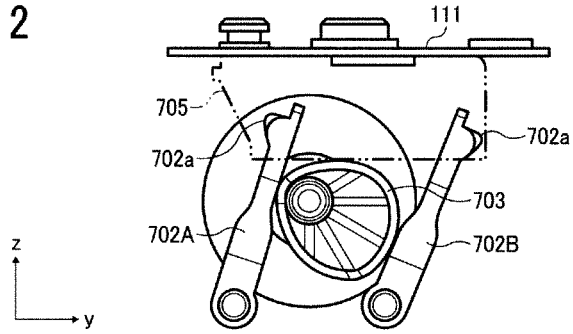
FIG. 12 is a side view of the driving device of FIG 11 in which a slide member is omitted.
Figure 13:
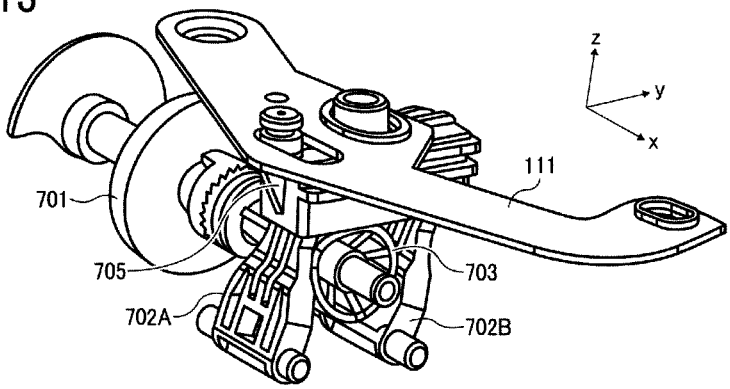
FIG. 13 is a perspective view of the driving device of FIG. 11.
Figure 14:
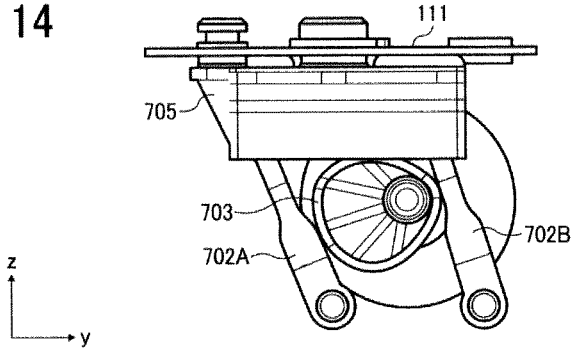
FIG. 14 is a side view of the driving device in the state in which the second maintenance device is placed at the second position.
Figure 15:
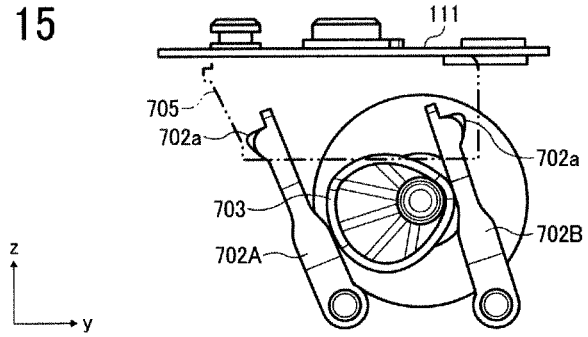
FIG. 15 is a side view of the driving device of FIG. 14 in which the slide member is omitted.
Figure 16:
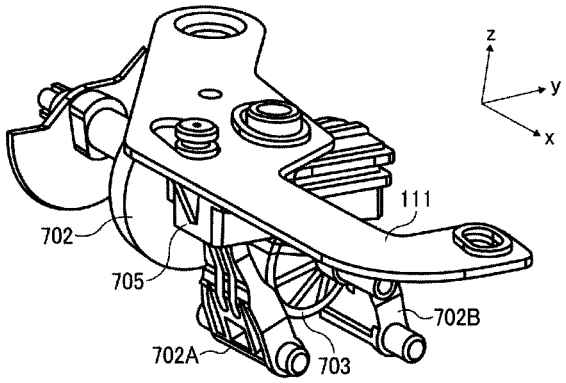
FIG. 16 is a perspective view of the driving device of FIG. 14.

FIGS. 11 and 12 are side views of the driving device 25 in the state in which the second maintenance device 22 is placed at the first position. FIG. 13 is a perspective view of the driving device 25 in the state in which the second maintenance device 22 is placed at the first position. FIGS. 14 and 15 are side views of the driving device 25 in the state in which the second maintenance device 22 is placed at the second position. FIG. 16 is a perspective view of the driving device 25 in the state in which the second maintenance device 22 is placed at the second position.

For the driving device 25, a slide cam 703 is rotated via gears, such as a worm gear 701, rotated by an output shaft of the first driving motor. Slide levers 702A and 702B contact a cam surface of the slide cam 703. The slide levers 702A and 702B are swingable in the sub-scanning direction (y-axis direction).

The slide levers 702A and 702B are connected to a slide member 705, and the slide member 705 is connected to the arm 111.

Thus, by rotating (driving) the first driving motor, the slide cam 703 is rotated. As a result, the slide levers 702A and 702B swing, thus swinging the arm 111 via the slide member 705.

For example, in FIGS. 11 to 13, when the right-side slide lever 702B is pushed by the slide cam 703, the arm 111 moves to the right direction, thus moving the second maintenance device 22 to the first position. By contrast, in FIGS. 14 to 16, when the left-side slide lever 702A is pushed by the slide cam 703, the arm 111 moves to the left direction, thus moving the second maintenance device 22 to the second position.

Figure 18:
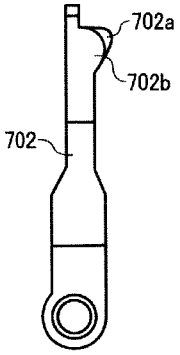
FIG. 18 is a side view of the slide lever of FIG. 17.
Figure 19:
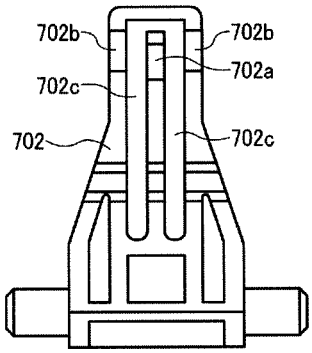
FIG. 19 is a front view of the slide lever of FIG. 17.

Next, the slide lever 702 of the driving device 25 in this exemplary embodiment is further described with reference to FIGS. 17 to 19.

Figure 17:
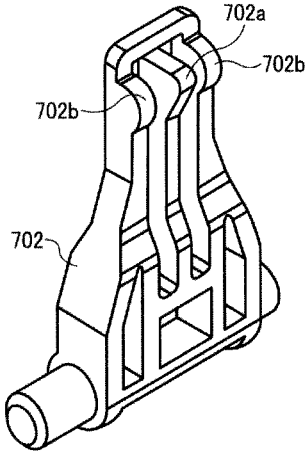
FIG. 17 is a perspective view of a slide lever of the driving device.

FIG. 17 is a perspective view of the slide lever 702 in this exemplary embodiment. FIG. 18 is a side view of the slide lever 702. FIG. 19 is a front view of the slide lever 702.

The slide lever 702 has a first pressing portion 702*a* and second pressing portions 702*b*. The first pressing portion 702*a* is separated from the second pressing portions 702*b* by a slit 702*c*. The first pressing portion 702*a* protrudes further than the second pressing portions 702*b* in a direction to push the slide member 705.

Thus, when the slide lever 702 pushes the slide member 705, the first pressing portion 702*a* deforms, As a result, a counter force of the first pressing portion 702*a* is applied to the arm ill via the slide member 705.

When the second maintenance device 22 is placed at the first position, as illustrated in FIGS. 11 and 12. the slide member 705 is pushed in the right direction on the y-axis. By contrast, when the second maintenance device 22 is placed at the second position, as illustrated in FIGS. 14 and 15, the slide member 705 is pushed in the left direction on the y-axis.

As a result, when the second maintenance device 22 is placed at the first position, the first reference shaft 304*a* is pressed against and stops in contact with the first contact portion 306 of the first guide portion 302*a*. When the second maintenance device 22 is placed at the second position, the first reference shaft 304*a* is pressed against and stops in contact with the second contact portion 307 of the first guide portion 302*a*.

In other words, the first pressing portion 702*a* of the slide lever 702 serves as a pressing member to press the second maintenance device 22 in a direction to bring the second maintenance device into contact with the first contact portion 306 or the second contact portion 307.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a carriage movable in a main scanning direction;

a first recording head mounted on the carriage, the first recording head having nozzles in a nozzle face thereof to eject liquid droplets;

a second recording head mounted on the carriage, the second recording head having nozzles in a nozzle face thereof to eject liquid droplets, the second recording head displaced from the first recording head on the carriage in a sub scanning direction perpendicular to the main scanning direction; and a maintenance assembly to maintain and recover the first recording head and the second recording head, wherein the maintenance assembly includes a frame member, a first maintenance device, and a second maintenance device, the frame member has a guide portion, a first contact portion, and a second contact portion, the first maintenance device is held by the frame member, the second maintenance device is reciprocally movable along the guide portion of the frame member in the sub scanning direction between a first position to oppose the first recording head and a second position to oppose the second recording head, and the second maintenance device stops at the first position in contact with the first contact portion and at the second position in contact with the second contact portion.

2. The image forming apparatus of claim 1, further comprising a pressing member to press the second maintenance device in a direction to bring the second maintenance device into contact with the first contact portion or the second contact portion.

3. The image forming apparatus of claim 1, further comprising a suction device to suck liquid from the nozzle face of the first recording head and the nozzle face of the second recording head, wherein the second maintenance device includes at least one of a wiping member to wipe the nozzle face of the first recording head and the nozzle face of the second recording head, a suction cap to cover the nozzle face of the first recording head and the nozzle face of the second recording head and connected to the suction device, and a dummy ejection receptacle to receive liquid droplets not contributing to image formation.

4. The image forming apparatus of claim 1, further comprising a suction device to suck liquid from the nozzle face of the first recording head and the nozzle face of the second recording head, wherein the first maintenance device includes a moisture retention cap to cover the nozzle face of the second recording head, the second maintenance device includes a suction cap to cover the nozzle face of the first recording head and the nozzle face of the second recording head, the suction cap connected to the suction device, and the suction cap sucks the liquid from the nozzle face of the first recording head at the first position and sucks the liquid from the nozzle face of the second recording head at the second position.

5. The image forming apparatus of claim 1, wherein the second maintenance device further includes a wiping member to wipe the nozzle face of the first recording head and the nozzle face of the second recording head, and wherein the wiping member wipes the nozzle face of the first recording head at the first position and wipes the nozzle face of the second recording head at the second position.

* * * * *